US006016792A

United States Patent [19]

Kawano et al.

[11] Patent Number: 6,016,792

[45] Date of Patent: Jan. 25, 2000

[54] LEAK TEST SYSTEM FOR VAPORIZED FUEL TREATMENT MECHANISM

[75] Inventors: Akihiro Kawano; Shinsuke Nakazawa, both of Kanagawa, Japan

[73] Assignee: Nissan Motor Co., Ltd., Yokohama, Japan

[21] Appl. No.: 09/049,145

[22] Filed: Mar. 27, 1998

[30] Foreign Application Priority Data

Mar. 28, 1997 [JP] Japan ..... 7-77853

[51] Int. Cl.[7] ..... F02M 33/02

[52] U.S. Cl. ..... 123/520; 123/198 D

[58] Field of Search ..... 123/520, 519, 123/518, 516, 198 D, 521

[56] References Cited

U.S. PATENT DOCUMENTS

| | | | |
|---|---|---|---|
| 5,237,979 | 8/1993 | Hyodo | 123/520 |
| 5,297,528 | 3/1994 | Mukai | 123/520 |
| 5,299,545 | 4/1994 | Kuroda | 123/198 D |
| 5,327,873 | 7/1994 | Ohuchi | 127/520 |
| 5,333,590 | 8/1994 | Thomson | 123/198 D |
| 5,353,771 | 10/1994 | Blumenstock | 123/520 |
| 5,425,344 | 6/1995 | Otsuka | 123/520 |
| 5,542,397 | 8/1996 | Takahata | 123/520 |
| 5,775,307 | 7/1998 | Isobe | 123/198 D |

FOREIGN PATENT DOCUMENTS 6-159157 6/1994 Japan .

*Primary Examiner*—Carl S. Miller
*Attorney, Agent, or Firm*—Foley & Lardner

[57] ABSTRACT

In a leak test system for a vaporized fuel treatment device of a vehicle using negative pressure, a pressure variation rate in a test flowpath is measured in a predetermined time interval, and a reference value which is larger than the minimum variation rate measured is set in a predetermined time interval. Sloshing in a fuel tank is determined by comparing a latest variation rate with the reference value on each occasion. In this way, sloshing can be detected with high precision at any stage of leak testing, and the leak test is stopped when sloshing is detected.

7 Claims, 8 Drawing Sheets

LEAK TEST SYSTEM FOR VAPORIZED FUEL TREATMENT MECHANISM

The contents of Tokugan Hei 9-77853, with a filing date of Mar. 28, 1997 in Japan, are hereby incorporated by reference.

FIELD OF THE INVENTION

This invention relates to a system for testing for vaporized fuel incorporated in a mechanism for treating vaporized fuel from a vehicle fuel tank.

BACKGROUND OF THE INVENTION

Regarding vaporized fuel treatment mechanisms for preventing fuel from being discharged into the atmosphere. On Board Diagnosis (OBD) guidelines established by the State of California provide that all North American vehicles manufactured after 1994 should be fitted with a system for testing for faults in a vaporized fuel treatment mechanism. These guidelines stipulate that when there is a leak hole of more than 1 mm diameter in a flowpath from a fuel tank to a purge cut valve, the leak must be detected, and a warning lamp lighted.

A diagnostic system in a vaporized fuel treatment mechanism meeting these requirements is disclosed for example in U.S. Pat. No. 5,542,397.

This system comprises a drain cut valve in a fresh air inlet port of a canister to make the flowpath a closed space, and a pressure sensor inserted in the flowpath. After the closed space has been converted to low pressure using intake negative pressure of the engine, the cross-sectional area of the leak hole is calculated based on the variation of flowpath pressure detected by the pressure sensor.

When the fuel in the fuel tank sloshes around or the liquid surface in the tank vibrates due to for example travel of the vehicle on a winding road, the amount of vaporized fuel in the tank sharply increases and the pressure in the flowpath rises. This phenomenon will be referred to as sloshing in the following description. If leak testing is performed under such a condition, it is possible that the result of the test will be erroneous. Referring to FIG. 4A of the drawings, according to the diagnostic algorithm of this device, the flowpath pressure and an elapsed time $DT_4$ are sampled at a point B at which the flowpath pressure has risen by a predetermined amount $p_3$ above its value at a point A. However, when a pressure change occurs due to sloshing as shown by the broken line of the figure, the flowpath pressure and elapsed time $DT_4$ are sampled at a point C. An error therefore occurs in the calculation of leak hole surface area, and consequently, the leak hole surface area corresponding to a time difference between the point B and point C is added to the real leak hole surface area.

To address this problem, Tokkai Hei 6-159157 published by the Japanese Patent Office in 1994 compares a variation amount $\Delta P$ in a predetermined interval of flowpath pressure with a predetermined value $\alpha$, determines that sloshing has occurred when $\Delta P$ is equal to or greater than $\alpha$, and stops leak testing at that time.

However, when the determining level $\alpha$ for determining sloshing is a fixed value, sufficiently high precision of the leak test is not obtained. FIG. 4B shows a variation amount $\Delta$EVPRES per predetermined interval of flowpath pressure in FIG. 4A. In this case, sloshing 1 shown by the broken line in the figure is correctly determined. However, as $\Delta$EVPRES is equal to or greater than $\alpha$ before a point D, it is incorrectly determined that sloshing has occurred regardless of whether or not it really did occur. To avoid such an incorrect determination, the sloshing determination must therefore be performed only after the point D, and as a result, sloshing 2 prior to point D cannot be detected.

SUMMARY OF THE INVENTION

It is therefore an object of this invention to detect sloshing with high precision at any stage of leak testing.

It is a further object of this invention to increase the opportunities for leak testing while avoiding sloshing.

In order to achieve the above objects, this invention provides a leak test system for a vaporized fuel treatment mechanism, comprising a fuel tank for supplying fuel to an engine mounted on a vehicle, an intake passage for aspirating air for combustion in the engine, a throttle provided in the intake passage for adjusting an amount of air flowing in the intake passage, a canister for adsorbing vaporized fuel, a first passage for leading vaporized fuel from the fuel tank into the canister, a first valve for opening and closing the first passage, a second passage connecting the canister and intake passage downstream of the throttle, a second valve for opening and closing the second passage, a third valve for introducing atmospheric air into the canister, a sensor for detecting a pressure in a flowpath section from the fuel tank to the second valve via the first passage, canister and second passage, and a microprocessor.

This microprocessor is programmed to open the second valve, lead negative pressure in the inlet pipe into the flowpath section, close the second valve so as to close the flowpath section with negative pressure therein, and determine if there is a leak in the flowpath section based on a pressure variation in the section after the section has been closed.

The microprocessor is further programmed to measure a pressure variation rate in a predetermined time interval after the section has been closed, set, in the predetermined time interval, a reference value larger by a predetermined amount than a minimum value of the variation rates which have been measured, determine that there is sloshing in the fuel tank when a latest variation rate exceeds the reference value, and stop determining of the leak when there is sloshing.

It is preferable that the microprocessor is further programmed to measure an elapsed time from when the flowpath section is closed, and set the predetermined amount to be larger as the elapsed time increases.

It is also preferable that the microprocessor is further programmed to resume determining of a leak when the latest variation rate falls below the reference value after determining of the leak has stopped once.

In this case, it is further preferable that the microprocessor is further programmed to resume determining of a leak when a predetermined time has elapsed after the latest variation rate falls below the reference value.

The variation rate is for example expressed as a differential pressure between a current pressure and a pressure measured one second earlier.

It is also preferable that the microprocessor is further programmed to determine If there is a leak in a time interval of 10 milliseconds, and to determine if there is sloshing in a fine interval of 200 milliseconds.

The details as well as other features and advantages of this invention are set forth in the remainder of the specification and are shown in the accompanying drawings.

DESCRIPTION OF THE PREFERRED EMBODIMENTS

U.S. Pat. No. 5,542,397, the disclosure of which is herein incorporated by reference, discloses a leak test system for a vaporized fuel treatment mechanism of a vehicle.

Herein, an embodiment will be described for applying this invention to leak testing using the negative pressure of the aforesaid test system.

Figure 1:
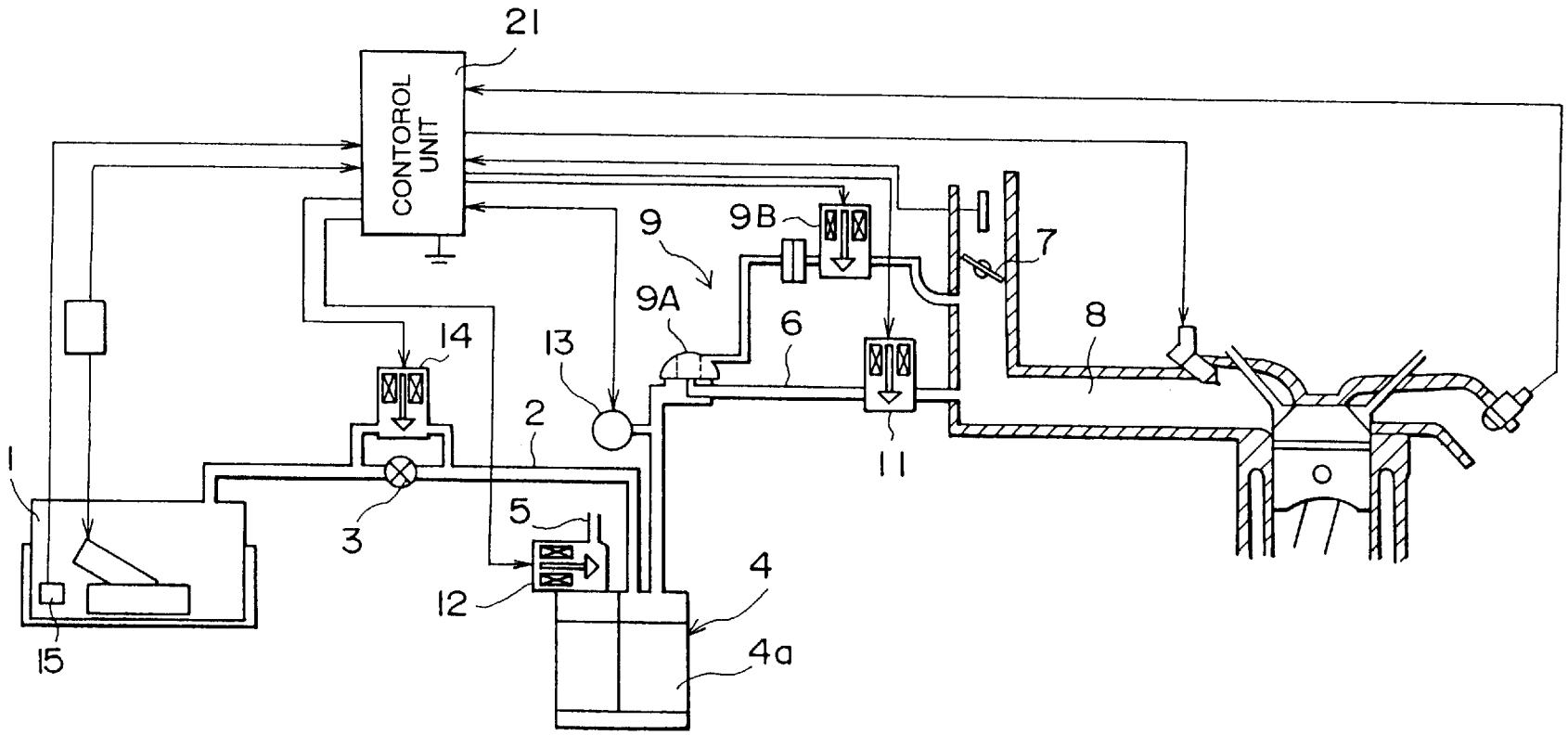
FIG. 1 is a schematic diagram of a leak test system according to this invention.

The construction of the hardware of this embodiment shown in FIG. 1 is same as that of the aforesaid U.S. Pat. No. 5,542,397, the difference between this embodiment and U.S. Pat. No. 5,542,397 being the process executed by a control unit 21.

FIGS. 2A–2D show a leak test process using negative pressure performed by the control unit 21. This leak test process is executed for example at an interval of ten milliseconds. In the following description, the leak test process using negative pressure is divided into three stages, i.e. Stage 4 from start of pressure reduction to completion of pressure reduction, Stage 5 from completion of pressure reduction to end of leak test, and Stage 6 from end of leak test to subsequent processing. Prior to performing leak test using negative pressure, leak test is performed using positive pressure which corresponds to Stages 1–3. Leak test using positive pressure is not the subject of this invention, and will therefore be omitted from the following description.

In a step S561, it is determined whether or not a leak test stop flag is 1. When the leak test stop flag is 1, the process is terminated, and when the leak test stop flag has a value other than 1, the routine proceeds to a step S501 and subsequent steps. The leak test stop flag will be described in detail hereafter.

In the step S501, it is determined whether or not leak test start conditions hold.

When these conditions hold, the routine proceeds to a step S502. The leak test start conditions are for example that a pressure sensor 13 is operating normally, and that there are no faults in the air supply valve 12 and bypass valve 14.

In the step S502, a leak test experience flag is determined. If leak test has not been performed since the vehicle started running, the leak test experience flag is 0. In this case, a negative pressure test condition flag showing whether the conditions are suitable for testing using negative pressure is determined in a step S503.

Negative pressure test conditions in the case of a vehicle having a manual transmission, are for example that the vehicle is in 4th or 5th gear, and the intake negative pressure is as much as −300 mm Hg.

When the negative pressure test condition flag=1. i.e. negative pressure test conditions hold, the processing of the step S504 and subsequent steps is performed.

When leak test conditions do not hold in the step S501, the leak test experience flag is not 0 in the step S502 or the negative pressure test condition does not hold in the step S503, the process is terminated without performing subsequent processing.

These flags are initialized to 0 at engine startup together with other flags described hereafter.

In the step S504, it is determined whether or not a Stage 4 flag is 0. This flag is initialized to 0 together with a Stage 5 flag and a Stage 6 flag described hereafter at engine startup.

When the Stage 4 flag is 0, a purge cut valve 9, purge control valve 11 and air supply valve 12 are closed and a bypass valve 14 is opened in a step S505. When the purge cut valve 9 is closed, purge is stopped if purging of vaporized fuel was being performed until then.

In a step S506, a flowpath pressure p is read from the output signal from the pressure sensor 13 and stored in a variable $P_0$ representing an initial pressure so that the flowpath pressure immediately prior to introduction of negative pressure can be sampled. By storing the flowpath pressure immediately prior to introducing negative pressure, there is no effect on the precision of computing a leak hole surface area A2 even if the flowpath pressure immediately prior to introducing negative pressure is different for each test, and in a step S507, the Stage 4 flag is set to 1.

By setting the Stage 4 flag to 1, the process proceeds from the step S504 to a step S508 on the next occasion that the process is executed. When the Stage 4 flag is 1, it indicates that the flowpath is decompressing.

In the step S508, it is determined whether or not the Stage 5 flag is 0. When the Stage 5 flag is 0, the routine proceeds to a step S509. As the initial value of the Stage 5 flag is 0 as described hereabove, on the first occasion that the process proceeds to the step S508, the process proceeds without fail to the step S509 thereafter.

In the step S509, the air supply valve 12 is closed and the bypass valve 14 is opened so as to close the flowpath from the fuel tank 1 to the purge cut valve 9. The purge control valve 11 is set to a small predetermined opening less than the maximum opening during purge. This opening is converted to a purge flowrate equivalent to several liters/min.

The operation of the valves in the step S509 must be performed in the specified sequence.

When the purge control valve 11 opens with a predetermined small opening, gas in the flowpath from the fuel tank 1 to the purge control valve 11 is aspirated by an intake pipe 8 via the purge control valve 11 due to the intake negative pressure of the engine, and the flowpath pressure drops.

According to this embodiment, testing is started immediately using negative pressure even when there is some positive pressure remaining in the fuel tank 1. Theoretically, it is desirable to restore the flowpath pressure to atmospheric pressure before introducing negative pressure. However, several seconds would be required for this operation, and there is a possibility that engine running conditions would deviate from negative pressure test conditions so that a leak test could no longer be performed. Therefore negative pressure is introduced immediately after the bypass valve is closed so as not to reduce the opportunities for leak testing.

In a step S510, it is determined whether or not a flag 2 is 0. The first time flag 2 is initialized to 0 at engine start up as well as a first time flag 4 and first time flag 5 described hereafter. Therefore on the first occasion when the process proceeds to the step S510, it proceeds without fail to a step S511.

In the step S511, a timer $T_3$ measuring the elapsed time from opening of the purge cut valve 9 is started. In a step S512, the first time flag 2 is set to 1 and the process is terminated.

When the process is performed on the next occasion, it proceeds from the step S510 to a step S513.

In the step S513, a differential pressure $P_0-p$ between the initial pressure $P_0$ and flowpath pressure p is compared with a predetermined value $p_2$. $p_2$ is set to a much smaller value than the intake negative pressure, e.g. +several tens of mm Hg. When $P_0-p \geqq p_2$, the routine proceeds to a step S514. When $P_0-p<p_2$, a timer value $T_3$ is compared with a predetermined time $t_4$. The predetermined time $t_4$ may be set to for example several minutes. When $T_s \geqq t_4$, the routine proceeds to a step S514. The process is terminated without performing subsequent processing only when the determination result of the step S513 is $T_9<t_4$.

In the step S514, a timer value $T_3$ measuring elapsed time from when the purge cut valve 9 is opened is entered in a variable $DT_3$, and stored.

The routine then proceeds to a step S515 where the Stage 5 flag is set to 1, and the process is terminated. By setting the Stage 5 flag to 1, the process proceeds from the step S508 to a step S516 on the next occasion when it is performed. The fact that the Stage 5 flag is 1 shows that a leak test is being performed.

In the step S516, it is determined whether or not the Stage 6 flag is 0. When the Stage 6 flag is 0, the routine proceeds to a step S517.

In the step S517, the purge cut valve 9, purge control valve 11 and air supply valve 12 are closed, and the bypass valve 14 is opened. Due to this, the flowpath from the fuel tank 1 to the purge cut valve 9 is closed.

In a step S518, it is determined whether or not the first time flag 3 is 0. The initial value of the first time flag 3 is 0, so on the first occasion when the process proceeds to the step S518, the process then proceeds to the step S519.

In a step S519, a timer $t_4$ which measures the elapsed time from when the timer purge cut valve 9 is closed is started. In the following step S520, the first time flag 3 is set to 1, and the process is terminated. Hence, when the process is performed on the next occasion, the process proceeds from the step S518 to a step S521.

In the step S521, it is determined whether or not a $t_5$ elapsed flag is 0. As the initial value of the $t_5$ elapsed flag is 0, when the process proceeds to the step S521 for the first time, the $t_5$ elapsed flag=0, and the process proceeds to a step S522.

In the step S522, it is determined whether or not the predetermined time $t_5$ has elapsed since the purge cut valve 9 was closed. $t_5$ corresponds to the delay time from when the gas flow stops after the purge cut valve 9 is closed to when there is no further pressure loss. $t_5$ is set to several seconds. When $t_5$ has elapsed, a pressure difference $P_0-p$ between the initial pressure $P_0$ and the flowpath pressure p is entered into a parameter $DP_3$ in a step S523. In the next step S523, the $t_5$ elapsed flag is set to 1 and the process is terminated.

By setting the $t_5$ elapsed flag to 1, the process proceeds from the step S521 to a step S525 on the next occasion when the process is executed.

In the step S525, a predetermined value $p_3$ is compared with the variable $DP_3$. The redetermined value $p_3$ is set to +several mm Hg.

When $DP_s \geqq p_3$, the differential pressure $P_0-p$ between the initial pressure $P_0$ and flowpath pressure p is entered in a variable $DP_4$ in a step S526. The timer value $t_4$ which started in the step S519 is also entered in the variable $DT_4$.

When $DP_3<p_3$, the timer value $t_4$ is compared with the predetermined time $t_4$, and when $t_4 \geqq t_4$, the process proceeds to the step S526. When $t_4<t_4$, the process is terminated without performing subsequent processing.

This completes the sampling of four values, i.e. $DP_3$, $DP_4$ for pressure and $DT_3$, $DT_4$ for time.

In a step S527, the leak hole surface area $AL_2$ is calculated from these four sampling values. $DP_3$, $DP_4$, $DT_3$ and $DT_4$ by equations (1) and (2). The calculation method is the same as that indicated by the aforesaid U.S. Pat. No. 5,542,697.

$$AL_2=K \cdot A' \tag{1}$$

$$A' = C \cdot \left(\frac{DT_3}{DT_4}\right) \cdot Ac \cdot \frac{\left(\sqrt{DP_3} - \sqrt{DP_4}\right)}{DP_3} \tag{2}$$

where,

Ac=orifice surface area ($mm^2$) of purge control valve during decompression.

C=correction coefficient (e.g. 26.6957) for adjusting units and

K=correction coefficient.

In a step S528, the leak hole surface area $AL_2$ is compared with a predetermined value $c_2$ in the step S528. When $AL_2<c_2$, it is determined in the step S529 that there is no leak.

When $AL_2 \geqq c_2$, the process proceeds to a step S530, and it is determined whether or not a leak test code is 1. The leak test code is data stored in a backup RAM of the control unit 2, and its initial value is 0.

Therefore, when $AL_2 \geqq c_2$ in the step S528, i.e. on the first occasion when it is determined that there is a leak, the leak test code is 0. In this case, the leak test code is set to 1 in the step S531, and it is again stored in the backup RAM. On the other hand, when the leak test code is 1, i.e. when it is not the first occasion when it is determined that there is a leak, a warning lamp lights on the driver's panel in the passenger compartment of the vehicle in a step S532.

In a step S533, a Stage 6 flag is set to 1, and the process is terminated.

When the Stage 6 flag is set to 1, the process proceeds from the step S516 to a step S534 on the next occasion when the process is executed. The fact that the Stage 6 flag is 1 shows that the leak test is complete.

In a step S534, the purge cut valve 9, purge control valve 11 and air supply valve 12 are opened, and the bypass valve 14 is closed. Due to this, purging of fuel is resumed.

In a step S535, a leak test experience flag is set to 1, and the process is terminated.

The leak test experience flag is reset to 0 on engine startup. If the leak test experience flag was previously set to 1, it remains at 1 while the engine is running. Leak test is nominally performed even in this state, but as the determination result of the step S502 is negative, the process is terminated without performing further processing. Hence, leak test is actually performed only once after engine startup until the engine stops.

When sloshing occurs in the fuel tank 1, the amount of vaporized fuel generated in the fuel tank 1 sharply increases, and the pressure of the aforesaid flowpath rises. In this state, it is not possible for a precise leak test to be performed.

Figure 3:
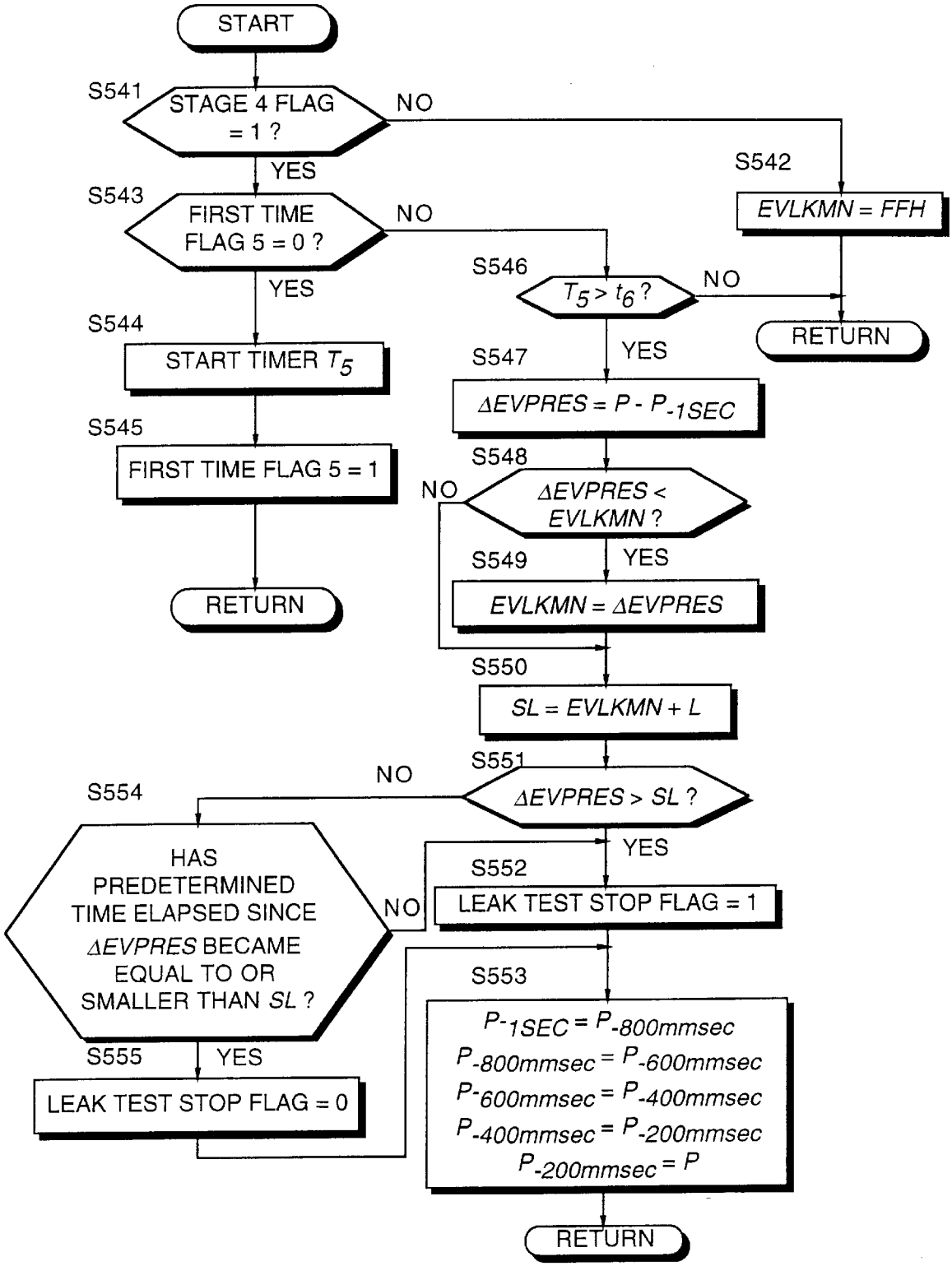
FIG. 3 is a flowchart describing a process for setting a leak test stop flag performed by the leak test system.

In order to stop leak test in such a case, in this leak test device, a step S561 is provided for determining a leak test stop flag in the above-mentioned leak test process, and the control unit 21 is programmed to execute a process for setting the leak test stop flag shown in FIG. 3.

This process is executed at an interval of for example 200 milliseconds independently from the process of FIGS. 2A–2D.

In the step S541, it is determined whether or not the Stage 5 flag is 1. When the Stage 5 flag is not 1, a pressure variation amount minimum value EVLKMN is set to a maximum value FFH in a step S542, and the process is terminated.

When the Stage 5 flag=1, a first time flag 5 is determined in a step S543. When the first time flag 5=0, a timer $t_5$ is started in a step S544. This timer $t_5$ has a function for measuring the elapsed time from when the leak test process sets the Stage 5 flag to 1. The first time flag 5 is set to 1 in the step S545, and the process is terminated.

Hence, the process proceeds from the step S543 to the step S546 on the next occasion when the process is executed.

In a step S546, the timer $t_5$ is compared with a predetermined time $t_6$. The predetermined time $t_6$ is set for example to one second. When $t_5 \leqq t_6$, the process is terminated. In other words, the routine proceeds to a step S547 after waiting until $t_5$ exceeds $t_6$.

In a step S547, a variation amount ΔEVPRES of flowpath pressure in a predetermined time of one second is calculated by the following equation (3).

$$\Delta EVPRES = p - p_{-1sec} \tag{3}$$

where, p=flowpath pressure at current time and $p_{-1sec}$=flowpath pressure one second earlier.

The reason why it is determined whether or not the timer value $t_5$ exceeded $t_6$ (1) in the step S546 is that the value of $p_{-1sec}$ cannot be obtained when at least one second has not elapsed since entering Stage 5.

In a step S548, the variation amount ΔEVPRES of flowpath pressure is compared with a variable EVLKMN, and when ΔEVPRES<EVLKMN, the value of ΔEVPRES is transferred to the variable EVLKMN in a step S549. When ΔEVPRES≧EVLKMN, the routine proceeds to a step S550.

The minimum value of ΔEVPRES up to this point is thereby stored in EVLKMN.

Figures 4A, 4B, 4C:
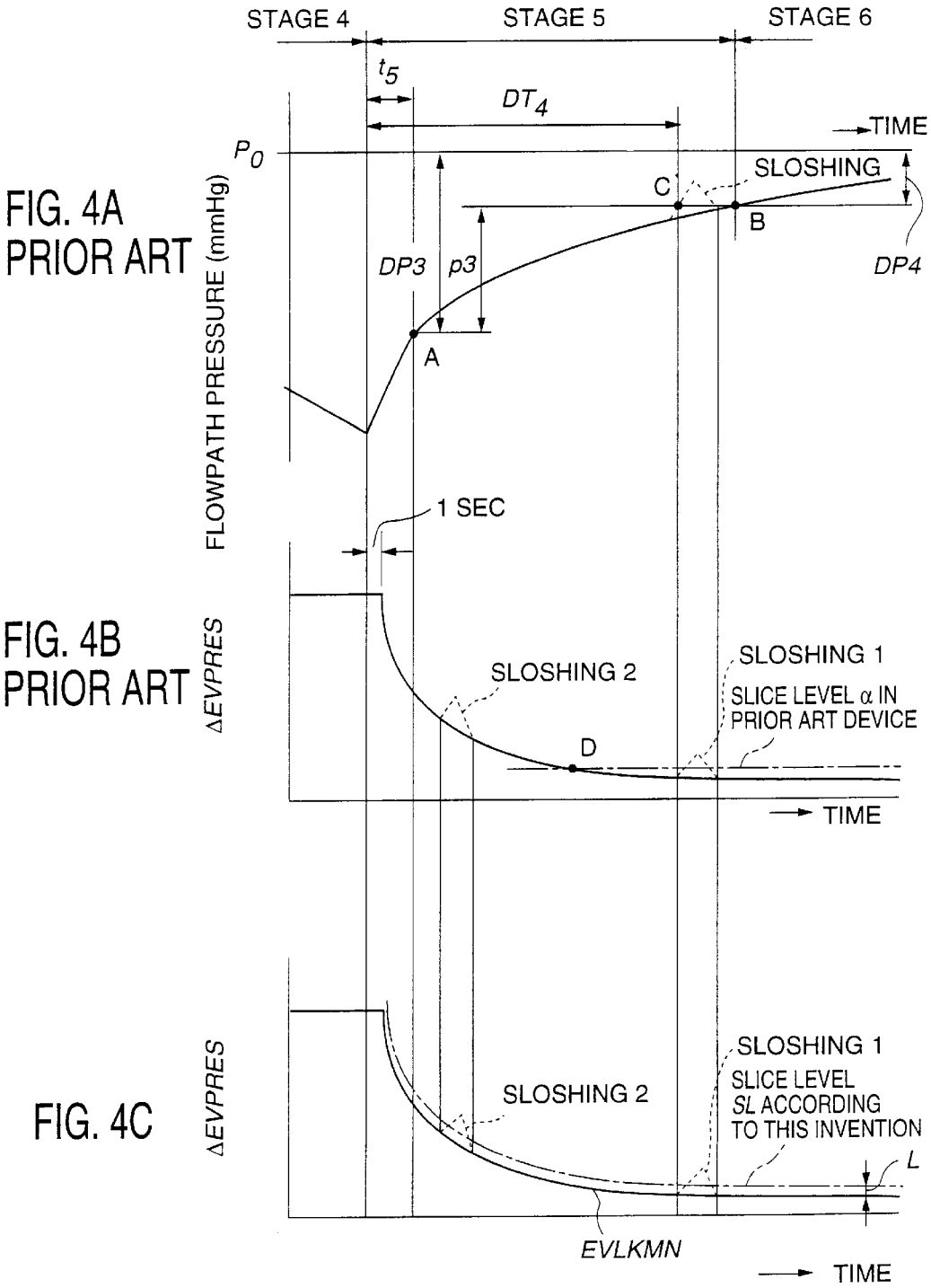
FIG. 4A PRIOR ART
FIG. 4B PRIOR ART
FIGS. 4A–4C are diagrams describing a difference of a sloshing determination algorithm of the leak test system and a system according to a prior art device.

The flowpath pressure p in leak test using negative pressure varies as a convex curve as shown in FIG. 4A. On the other hand, the variable EVLKMN varies as a concave curve as shown by the solid line in FIG. 4C.

ΔEVPRES and EVLKMN actually have a step-like waveform like that of a determining level SL described hereafter, but they are shown as smooth curves in FIGS. 4A–4C for convenience.

In the step S550, a value obtained by adding a predetermined positive value L to EVLKMN is set as the determining level (reference value) SL, and in a step S551, ΔEVPRES is compared with this determining level SL. When ΔEVPRES>SL, it is determined that sloshing is occurring, and the leak test stop flag is set to 1 in a step S552. Herein, the leak test stop flag=0 indicates the release of leak test stop, and the leak test stop flag=1 indicates the stopping of leak test.

The initial value of the leak test stop flag is 0. An appropriate value for the predetermined value L is selected according to the height of sloshing.

When ΔEVPRES≦SL in the step S551, the routine proceeds to a step S554 and it is determined whether or not a predetermined time has elapsed since ΔEVPRES≦SL. When the predetermined time has not elapsed, the routine proceeds to the step S552 and the leak test stop flag is set to 1. When the predetermined time has elapsed, the leak test stop flag is reset to 0 in a step S555.

The reason for resetting the leak test stop flag to 0 after the predetermined time has elapsed, is that when sloshing continues for a short time it is undesirable that the leak test stop flag fluctuates between 1 and 0 for a short time correspondingly.

Finally, the values necessary for executing the process on the next occasion are stored in a step S553. The control unit 21 comprises a memory holding five registers, i.e. $p_{-200msec}$, $p_{-400msec}$, $p_{-600msec}$, $p_{-800msec}$ and $p_{-1sec}$, and the value in each register is shifted to the register for the older value on each occasion when the process is executed.

The reason why the execution time of this process is as long as 200 milliseconds is that pressure variations occur relatively slowly in the flowpath during leak test after the flowpath from the fuel tank 1 to the purge cut valve 9 is decompressed, and there is therefore no need to sample the variation amount ΔEVPRES of the flowpath pressure more frequently.

Figure 2A:
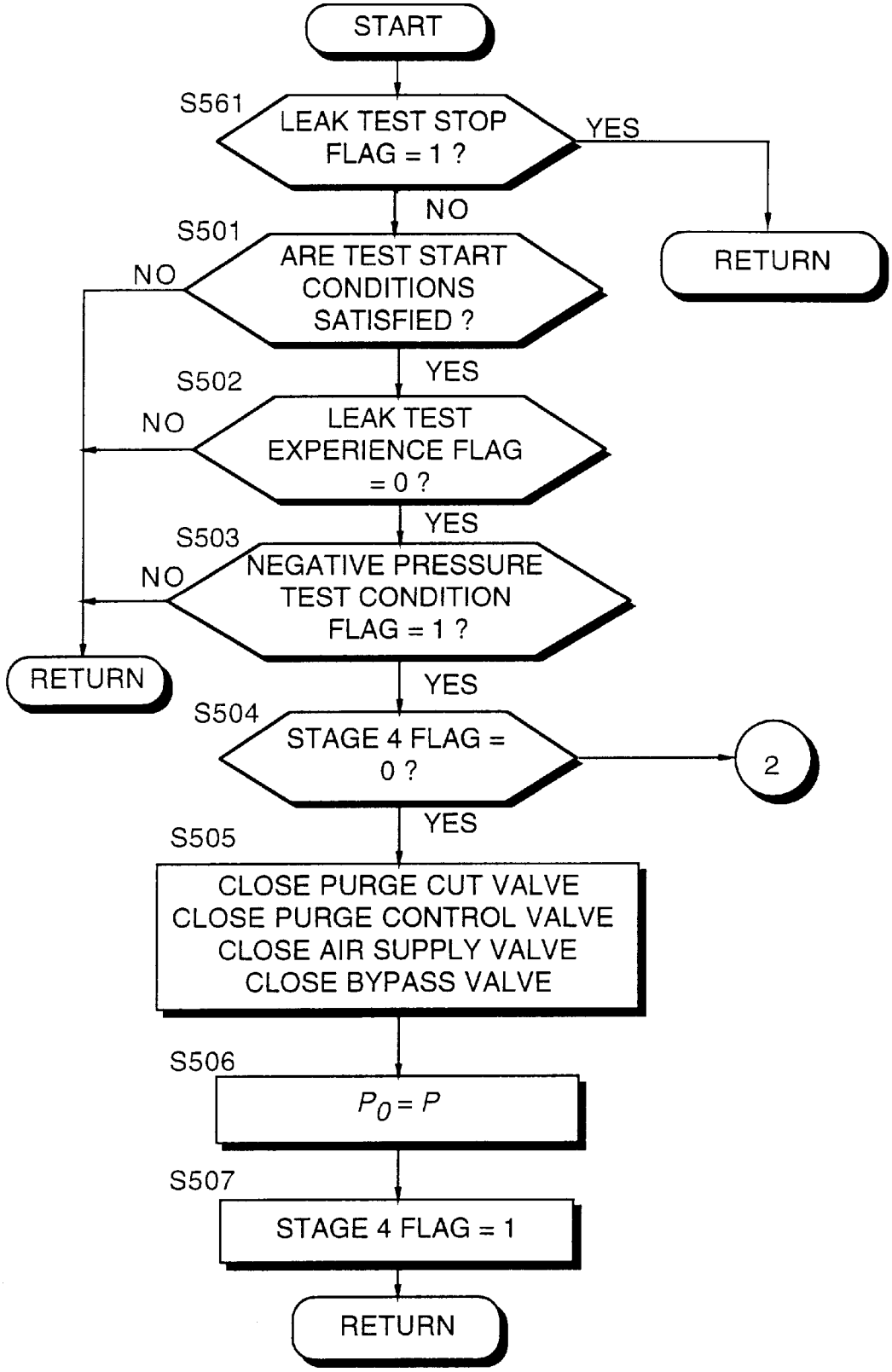
FIGS. 2A–2D are flowcharts describing a leak testing process performed by the leak test system.
Figure 2B:
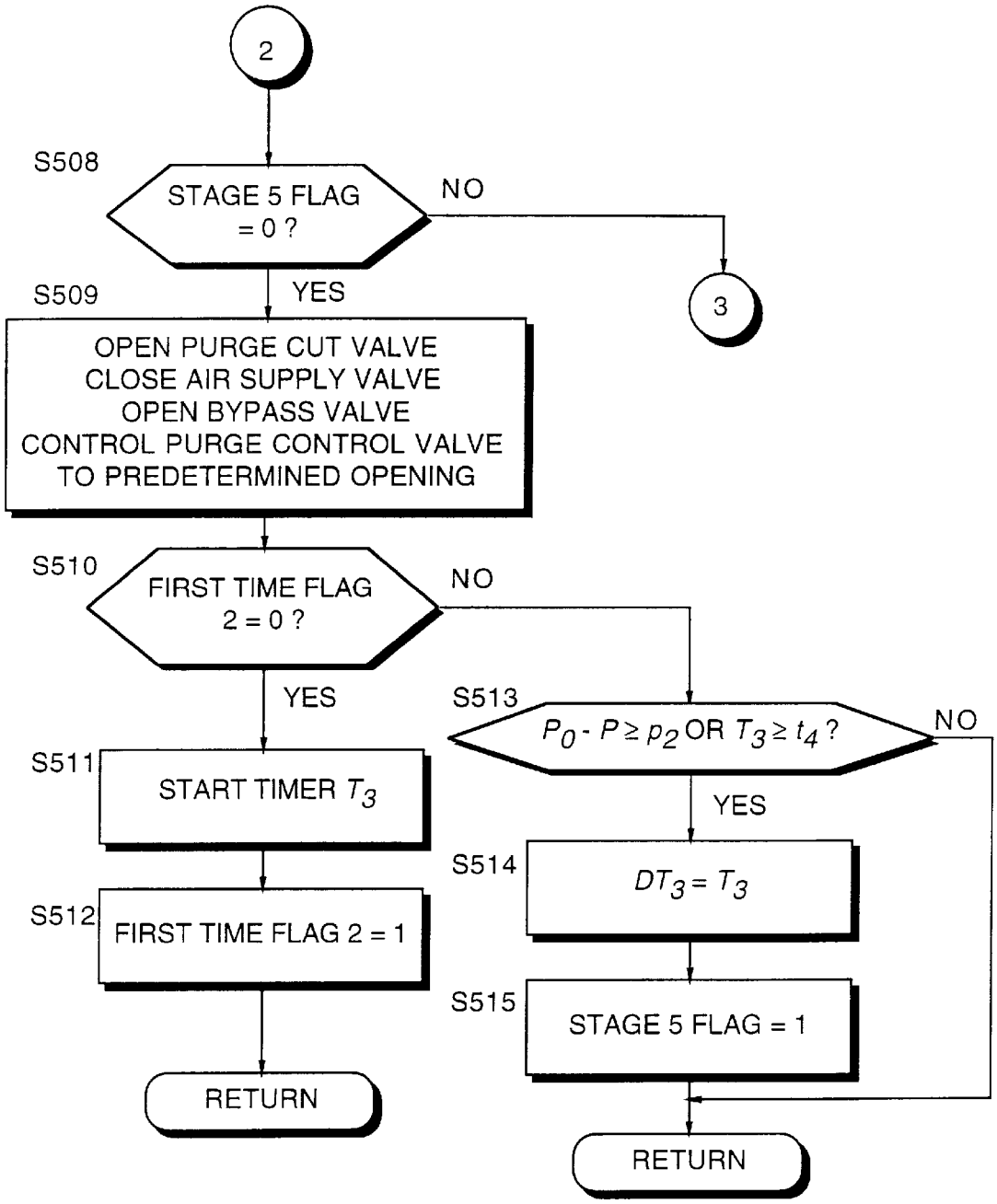
Figure 2C:
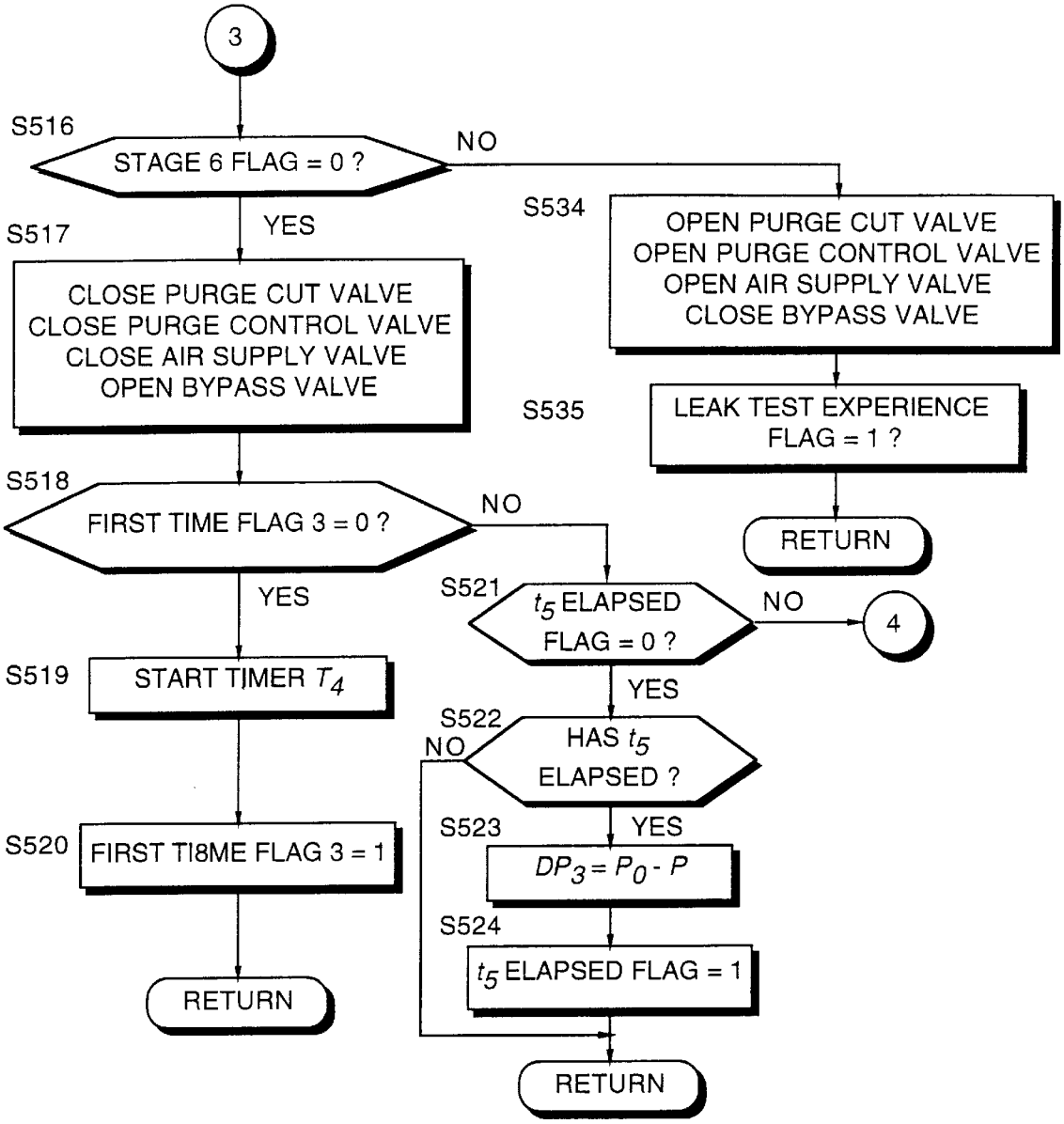
Figure 2D:
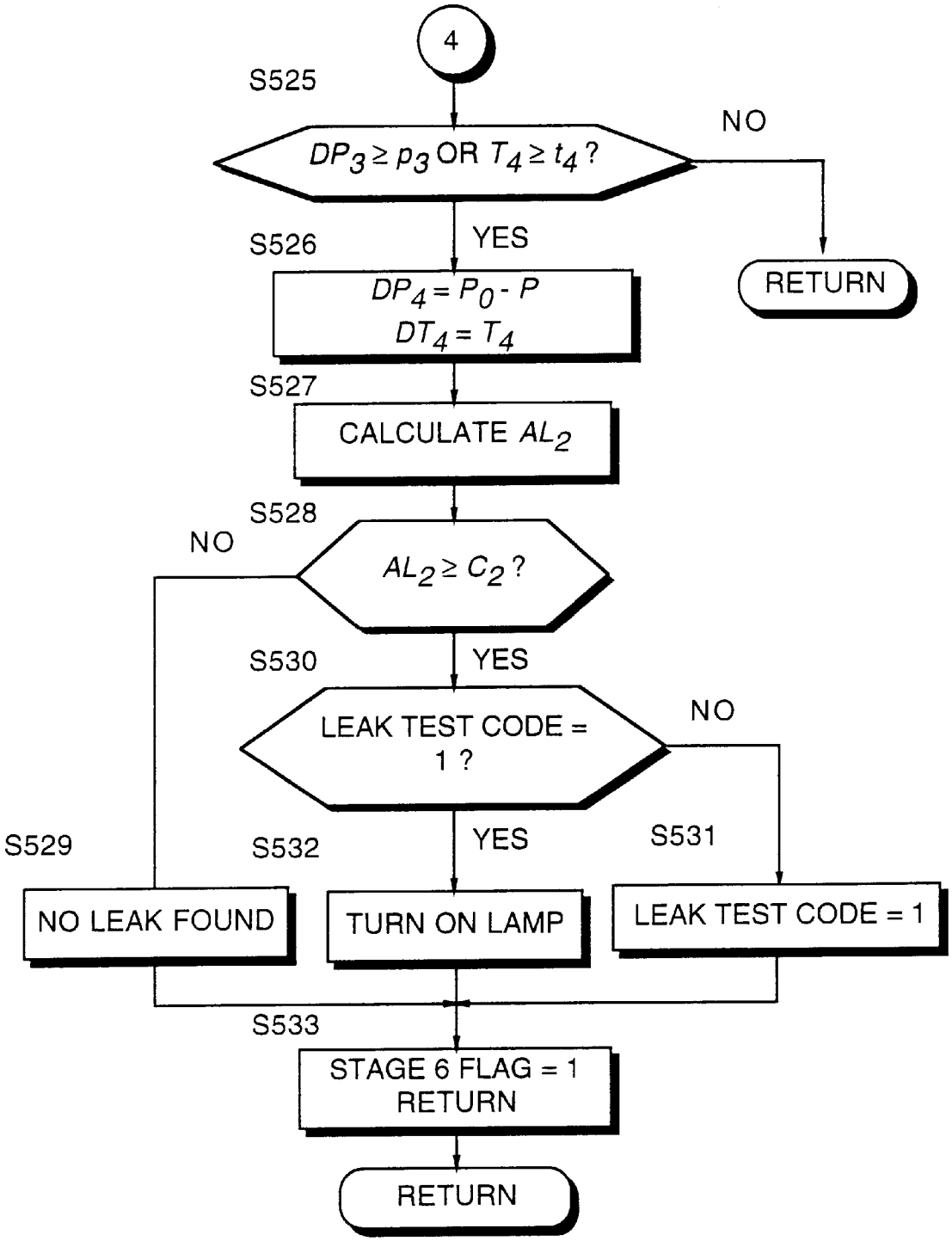

The leak test stop flag set as described above is determined by a first step S561 in the process of FIG. 2A.

When the engine first starts, the leak test stop flag initially has an initial value of 0. However even when leak test has started, if the leak test stop flag is set to 1 due to sloshing in the fuel tank 1, the processing of the step S501 and subsequent steps can no longer be performed in the leak test process and leak testing stops.

When sloshing stops and the leak test stop flag returns to 0, the processing of the step S501 and subsequent steps becomes possible in the leak test process. In this case, leak testing is restarted as soon as the negative pressure test condition is met.

According to this test system, the determining level varies together with the variation amount ΔEVPRES of flowpath pressure as shown in FIG. 4C. Therefore, sloshing 2 before the point D which could not be determined in the prior art device wherein the determining level was a fixed value as shown in FIG. 4B, can now be determined.

The vaporized fuel processor applying this diagnostic system comprises the purge cut valve 9 and purge control valve 11, but if the purge control valve 11 has the functions of both of these valves, the invention may be applied also to a device not comprising the purge cut valve 9.

Also, instead of the purge cut valve 9 comprising a diaphragm actuator 9A and three-way solenoid valve 9B, it may instead comprise a solenoid type ON/OFF valve which directly responds to a signal from the control unit 21.

A second embodiment of this invention will now be described referring to FIG. 5.

Figure 5:
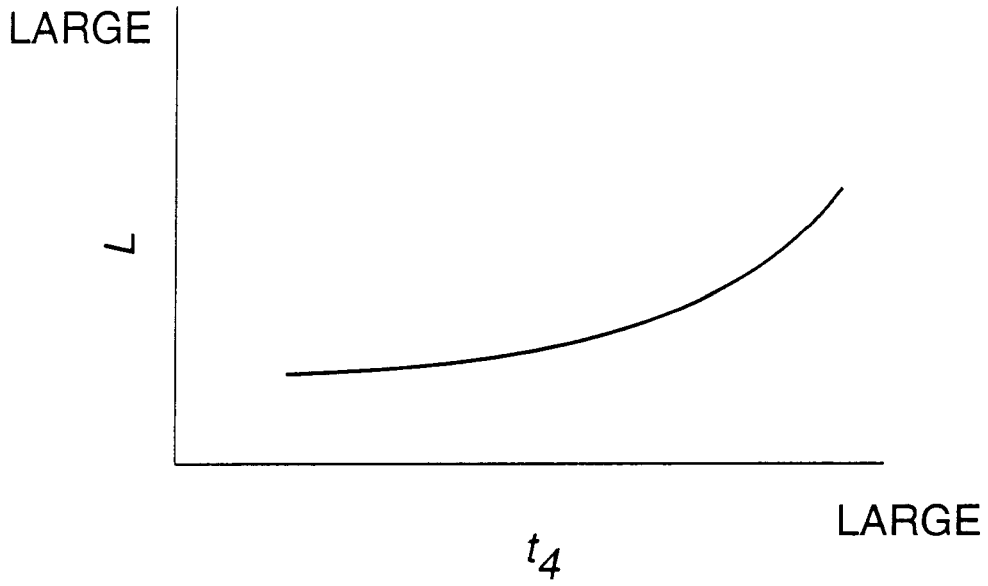
FIG. 5 is a diagram describing the characteristics of a predetermined value L according to a second embodiment of this invention.

In the aforesaid first embodiment, the predetermined value L had a positive fixed value, but according to this embodiment, the predetermined value L increases according to an elapsed time $t_4$ from Stage 5 as shown in FIG. 5.

For example, the gradient of flowpath pressure p in Stage 5 may be written as Δp/Δt, and the sloshing amount may be written as x. Δp refers to the pressure increase from a point A, and Δt refers to an elapsed time from the point A in FIG. 4A. The difference of gradient of the flowpath pressure p when there is sloshing and when there is not is x/Δt. Herein, Δt increases and the effect of sloshing on pressure gradient decreases the later the timing at which sloshing occurs after the point A in FIG. 4A. Therefore, if it is attempted to detect sloshing based not on the magnitude of the sloshing itself, but on the error in the pressure gradient due to sloshing, the predetermined value L should be increased the later the timing at which sloshing occurs, i.e. the larger $t_4$.

According to this embodiment wherein the predetermined value L is increased according to the elapsed time $t_4$, therefore, a level of sloshing at which an error appears in leak testing can be detected with high precision over all regions of Stage 5.

The corresponding structures, materials, acts, and equivalents of all means plus function elements in the claims below are intended to include any structure, material, or acts for performing the functions in combination with other claimed elements as specifically claimed.

The embodiments of this invention in which an exclusive property or privilege is claimed are defined as follows:

We claim:

1. A leak test system for a vaporized fuel treatment mechanism, comprising:

a fuel tank for supplying fuel to an engine mounted on a vehicle, an intake passage for aspirating air for combustion in said engine, a throttle provided in said intake passage for adjusting an amount of a flowing in said intake passage, a canister for adsorbing vaporized fuel, a first passage for leading vaporized fuel from said fuel tank into said canister, a first valve for opening and closing said first passage, a second passage connecting said canister and intake passage downstream of said throttle, a second valve for opening and closing said second passage, a third valve for introducing atmospheric air into said canister, a sensor for detecting a pressure in a flowpath section from said fuel tank to said second valve via said first passage, canister and second passage, and a microprocessor programmed to:

open said second valve, lead negative pressure in said inlet pipe into said flowpath section, close said second valve so as to close said flowpath section with negative pressure therein, determine if there is a leak in said flowpath section based on a pressure variation in said section after said section has been closed, measure a pressure variation rate in a predetermined time interval after said section has been closed, set, in said predetermined time interval, a reference value larger by a predetermined amount than a minimum value of the variation rates which have been measured, determine that there is sloshing in said fuel tank when a latest variation rate exceeds said reference value, and stop determining of the leak when there is sloshing.

2. A leak test system as defined in claim 1, wherein said microprocessor is further programmed to measure an elapsed time from when said flowpath section is closed, and set said predetermined amount to be larger as said elapsed time increases.

3. A leak test system as defined in claim 1, wherein said microprocessor is further programmed to resume determining of a leak when said latest variation rate falls below said reference value after determining of said leak has stopped once.

4. A leak test system as defined in claim 3, wherein said microprocessor is further programmed to resume determining of a leak when a predetermined time has elapsed after said latest variation rate falls below said reference value.

5. A leak test system as defined in claim 1, wherein said variation rate is expressed as a differential pressure between a current pressure and a pressure measured one second earlier.

6. A leak test system as defined in claim 1 wherein said microprocessor is further programmed to determine if there is a leak in a time interval of 10 milliseconds, and to determine if there is sloshing in a time interval of 200 milliseconds.

7. A leak test system for a vaporized fuel treatment mechanism, comprising:

a fuel tank for supplying fuel to an engine mounted on a vehicle, an intake passage for aspirating air for combustion in said engine, a throttle provided in said intake passage for adjusting an amount of air flowing in said intake passage, a canister for adsorbing vaporized fuel, a first passage for leading vaporized fuel from said fuel into said canister, a first valve for opening and closing said first passage, a second passage connecting said canister and intake passage downstream of said throttle, a second valve for opening and closing said second passage, a third valve for introducing atmospheric air into said canister, a sensor for detecting a pressure in a flowpath section from said fuel tank to said second valve via said first passage, canister and second passage, means for opening said second valve, means for leading negative pressure in said inlet pipe into said flowpath section, means for closing said second valve so as to close said flowpath section with negative pressure therein, means for determining if there is a leak in said flowpath section based on a pressure variation in said section after said section has been closed, means for measuring a pressure variation rate in a predetermined time interval after said section has been closed, means for setting, in said predetermined time interval, a reference value larger by a predetermined amount than a minimum value of the variation rates which have been measured, means for determining that there is sloshing in said fuel tank when a latest variation rate exceeds said reference value, and means for stopping determining of a leak when there is sloshing.

* * * * *

UNITED STATES PATENT AND TRADEMARK OFFICE

CERTIFICATE OF CORRECTION

PATENT NO. : 6,016,792
DATED : January 25, 2000
INVENTOR(S) : Akihiro KAWANO.

It is certified that error appears in the above-identified patent and that said Letters Patent is hereby corrected as shown below:

On the title page under item [30],

Foreign Application Priority Data change "7-77853" to - - 9-77853- -.

Signed and Sealed this

Third Day of April, 2001

*Attest:*

Nicholas P. Godici

NICHOLAS P. GODICI

*Attesting Officer*

*Acting Director of the United States Patent and Trademark Office*